US009605426B2

(12) United States Patent
Robins et al.

(10) Patent No.: US 9,605,426 B2
(45) Date of Patent: Mar. 28, 2017

(54) METHOD OF INSTALLING RADIANT BARRIER OR INSULATION

(71) Applicant: Products Innovation Group, Inc., Rochelle, VA (US)

(72) Inventors: Evelyn M. Robins, Ruckersville, VA (US); Anthony W. Morris, Tampa, FL (US)

(73) Assignee: EVELYN'S LEAFSOLUTION, LLC, Rochelle, VA (US)

( * ) Notice: Subject to any disclaimer, the term of this patent is extended or adjusted under 35 U.S.C. 154(b) by 0 days.

(21) Appl. No.: 14/861,230

(22) Filed: Sep. 22, 2015

(65) Prior Publication Data

US 2016/0090734 A1 Mar. 31, 2016

Related U.S. Application Data

(60) Provisional application No. 62/055,131, filed on Sep. 25, 2014.

(51) Int. Cl.
*E04D 13/16* (2006.01)
*E04B 1/76* (2006.01)

(52) U.S. Cl.
CPC ..... *E04B 1/7654* (2013.01); *E04B 1/762* (2013.01); *E04B 1/7604* (2013.01); *E04D 13/1631* (2013.01); *E04B 2001/7691* (2013.01)

(58) Field of Classification Search
CPC ..... E04B 1/767; E04B 1/7662; E04B 1/7604; E04B 1/7654; E04B 1/762; E04D 13/1625; E04D 13/1637; E04D 13/172
USPC ..... 52/407.2
See application file for complete search history.

(56) References Cited

U.S. PATENT DOCUMENTS

| | | | | |
|---|---|---|---|---|
| 1,689,320 | A * | 10/1928 | Bradbury | E04B 1/7654 52/479 |
| 2,955,063 | A * | 10/1960 | Driscoll | E04B 1/7654 206/321 |
| 8,137,170 | B2 * | 3/2012 | Klement | E04D 13/178 126/621 |
| 8,347,562 | B2 * | 1/2013 | Morris | E04D 13/1631 428/163 |
| 2007/0181704 | A1 * | 8/2007 | Ernst | F24D 3/14 237/70 |
| 2008/0000181 | A1 * | 1/2008 | Sillik | E04B 1/7654 52/404.3 |

(Continued)

*Primary Examiner* — Brian Mattei
*Assistant Examiner* — Paola Agudelo
(74) *Attorney, Agent, or Firm* — Nixon & Vanderhye, P.C.

(57) ABSTRACT

A method of installing a self-supporting radiant barrier or insulation between roof joists or wall studs secured to an exterior building surface. Flexible and resilient strips are positioned in an inwardly bowed condition between adjacent roof joists or wall studs. A radiant barrier or insulation is positioned between the adjacent roof joists or wall strips in a bowed condition in engagement with the bowed strips. Thereafter, flexible and resilient rods are positioned in a bowed condition in engagement with the roof joists or wall studs, the radiant barrier or insulation and over the bowed strips to secure the radiant barrier or insulation to the underlying bowed strips and the adjacent roof joists or wall studs. The bowed strips, radiant barrier or insulation and the bowed rods are all located within the interior surfaces of the roof joists or wall studs.

5 Claims, 6 Drawing Sheets

(56) References Cited

U.S. PATENT DOCUMENTS

| | | | | |
|---|---|---|---|---|
| 2013/0203312 | A1* | 8/2013 | Jordan | E04B 1/7654 442/2 |
| 2015/0079330 | A1* | 3/2015 | Morris | E04B 1/78 428/72 |
| 2016/0083958 | A1* | 3/2016 | Dowd | E04B 1/7654 52/404.3 |

* cited by examiner

METHOD OF INSTALLING RADIANT BARRIER OR INSULATION

CROSS REFERENCE TO RELATED APPLICATIONS

The present application claims the priority of provisional application No. 62/055,131 filed on Sep. 25, 2014.

BACKGROUND OF THE INVENTION

Field of the Invention

The present invention relates to a method of installing a radiant barrier or insulation and, more particularly, to such a method for installing the radiant barrier or insulation between roof joists or support studs.

Description of the Background Art

At the present time, radiant barriers or insulation are typically installed extending over roof joists or support studs with staples or nails secured to the interior surface of the roof joists or wall studs. Such an installation provides the required air space needed for radiant barriers, for example, but makes it difficult to install drywall or any wall covering over the roof joists or wall studs if it is desired to convert an attic or other area into a living space. Accordingly, a need has arisen for a new and improved method of installing a radiant barrier or insulation between roof joists or wall studs which is not subject to the above described disadvantage. The method of the present invention meets this need.

BRIEF SUMMARY OF THE INVENTION

In accordance with the method of the present invention, flexible and resilient strips are installed in an inwardly bent position at a desired spacing between the outer surfaces of the roof joists or support studs to provide an air space with the adjacent outer surface such as a roof or wall. The strips are positioned within the inner surfaces of the roof joists or wall studs and may be formed of any suitable material such as metal, plastic or the like.

A radiant barrier or insulation of the self-supporting type is then installed between the adjacent roof joists or wall studs in engagement with the inwardly bowed strips and is disposed within the inner surfaces of the roof joists or wall studs.

Thereafter, pointed flexible and resilient rods made of any suitable metal or plastic material are installed over the radiant barrier or insulation with their ends in engagement with the roof joists or wall studs. The rods are installed over the inner bowed strips to support and maintain the position of the radiant barrier or insulation on the strips within the roof joints or wall studs.

In this manner, all of the radiant barriers or insulation are installed within the roof joists or wall studs so that drywall or other interior surfaces can be secured directly to the interior surfaces of the roof joists or wall studs when it is desired to construct or modify an interior living space. No other tools or fasteners are required for this installation method.

DETAILED DESCRIPTION OF THE INVENTION

Figure 1:
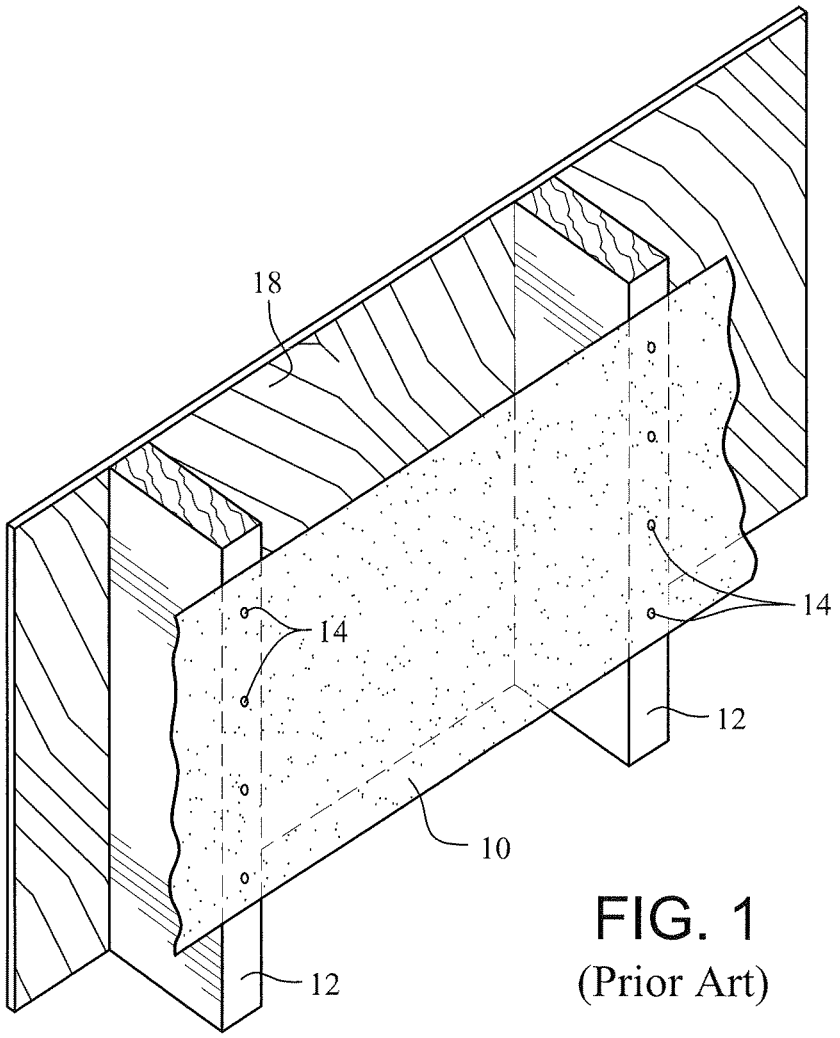
FIG. 1 (Prior Art)
FIG. 1 is a perspective view showing the prior art method of installing the radiant barrier or insulation over roof joists or wall studs.

FIG. 1 shows a prior art method of installing a radiant barrier or insulation 10 over the interior surface of roof joists or support studs 12 with connecting members such as staples or nails 14 secured to the interior surface of the roof joists or wall studs 12. Such an installation provides the required air space needed for radiant barriers but makes it difficult to install drywall or any wall covering over the interior surfaces of the roof joists or wall studs 12 if it is desired to convert an area into a living space.

Figure 2:
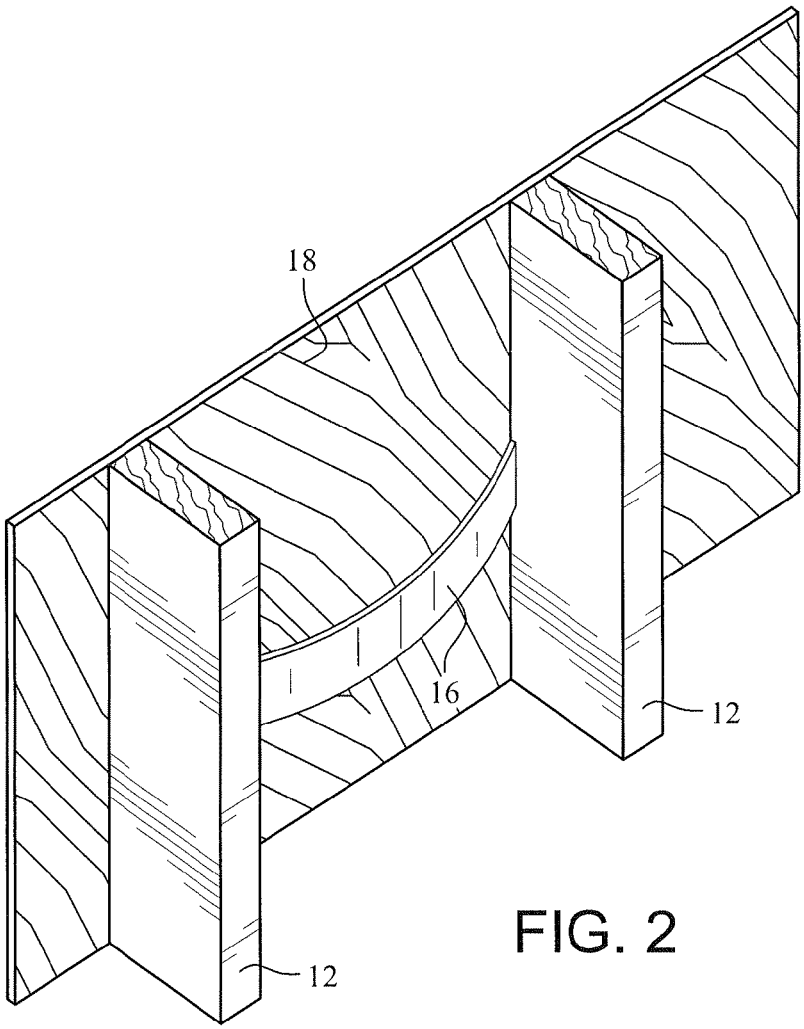
FIG. 2 is a perspective view showing a first step of the present method wherein bowed strips are installed between the roof joists or wall studs.

In accordance with the new and improved method of the present invention as shown in FIG. 2, flexible and resilient strips 16 are installed in an inwardly bent position at a desired spacing between the outer surfaces of the roof joists or support studs 12 to provide an air space with the adjacent outer surface such as a roof or wall 18. The strips 16 are positioned within the inner surfaces of the roof joists or wall studs 12 and may be formed of any suitable material such as metal, plastic or the like.

Figure 3:
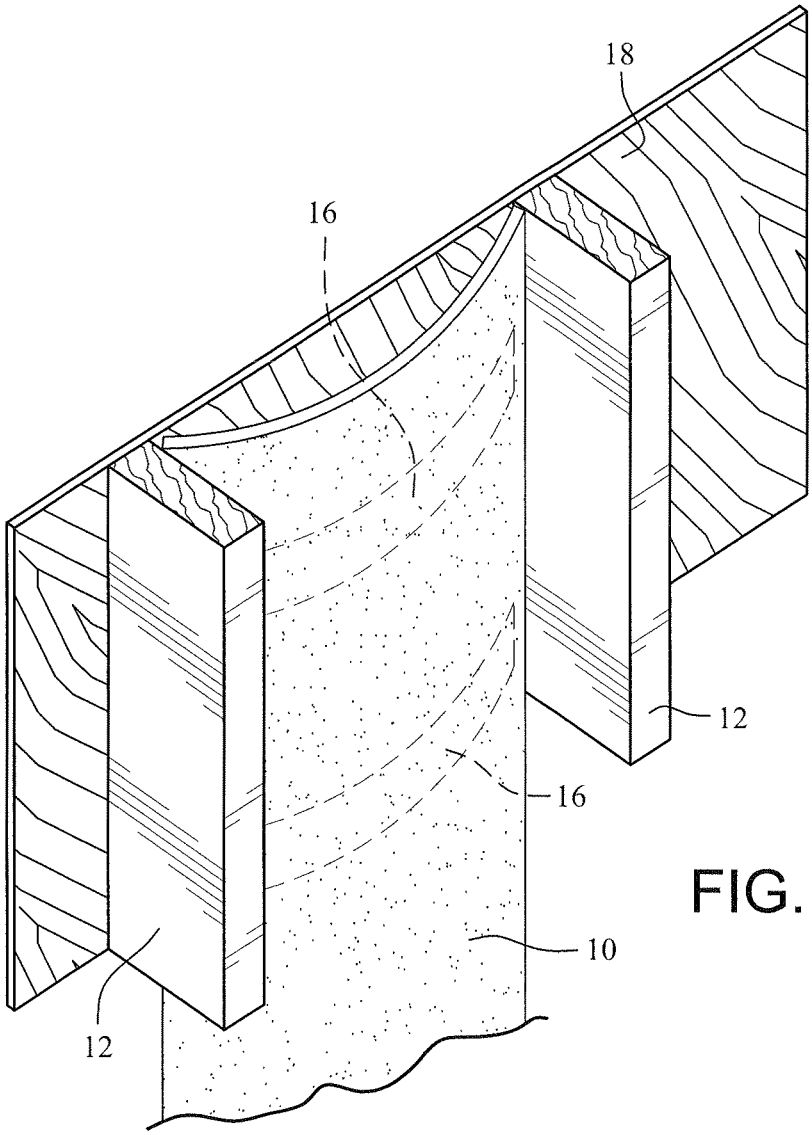
FIG. 3 is a perspective view showing a second step of the present method wherein elongated radiant barrier or insulation is installed between the roof joists or wall studs in engagement with the bowed strips.

Thereafter, as shown in FIG. 3, a radiant barrier or insulation 10 of the self-supporting type is then installed between the adjacent roof joists or wall studs 12 in engagement with the inwardly bowed strips 16 and is disposed within the inner surfaces of the roof joists or wall studs 12.

Figure 4:
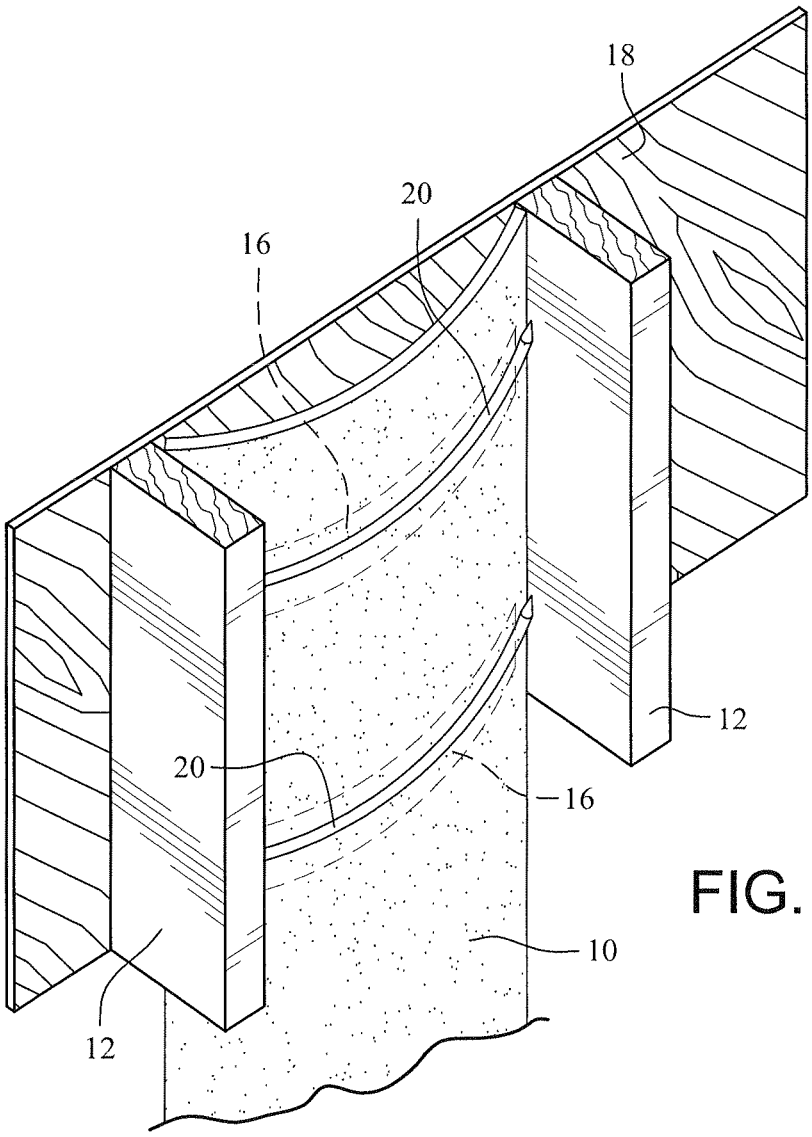
FIG. 4 is a perspective view showing a third step of the present method wherein rods are positioned in bowed condition between the roof joists or wall studs over the radiant barrier or insulation in overlying relation to each of the underlying strips to maintain and support the radiant barrier or insulation in bowed condition on the underlying strips.

As shown in FIG. 4, thereafter pointed flexible and resilient rods 20 made of any suitable metal or plastic material are installed over the radiant barrier or insulation 12 with their ends in engagement with the roof joists or wall studs 12. The rods 20 are installed over the inner bowed strips 16 to support and maintain the position of the radiant barrier or insulation 10 on the strips 16 within the roof joints or wall studs 12.

According to the present invention, all of the radiant barriers or insulation 10 are installed within the roof joints or wall studs 12 so that drywall or other interior surfaces can be secured directly to the interior surfaces of the roof joists or wall studs 12 when it is desired to construct or modify an interior living space. No other tools or fasteners are required for this new and improved installation method.

Figure 5:
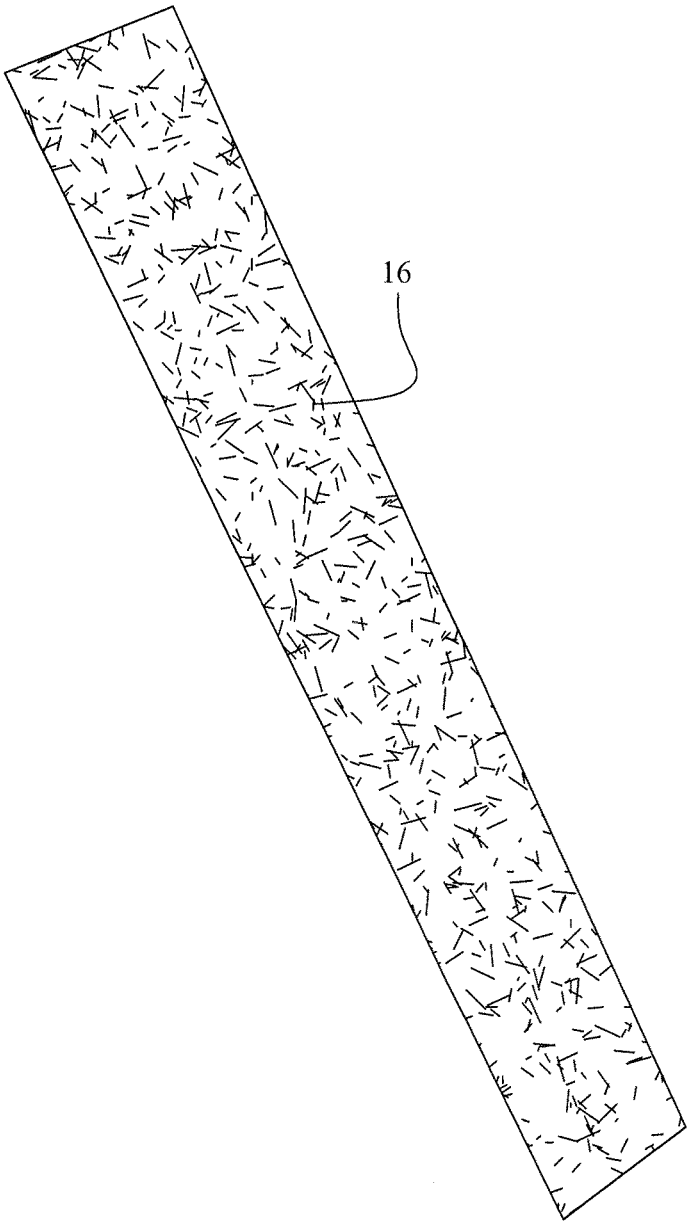
FIG. 5 is a plan view of a strip for use in the method of the present invention.

FIG. 5 illustrates one embodiment of a flexible and resilient strip 16 for use in the method of the present invention.

Figure 6:
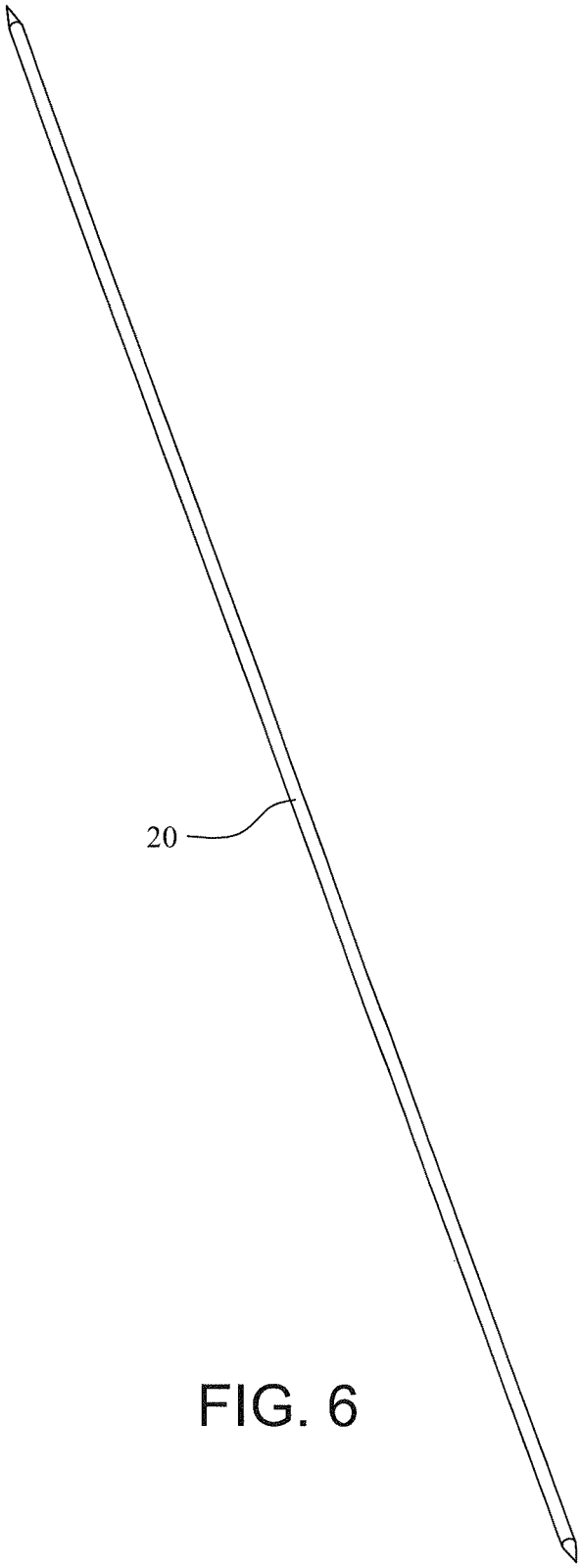
FIG. 6 is a plan view of a rod to be used in the method of the present invention.

FIG. 6 illustrates one embodiment of a flexible and resilient rod 20 to be used in the method of the present invention. The rod 20 is provided with pointed ends for firm engagement with the adjacent surfaces of the roof joists or wall studs 12.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of installing a self-supporting radiant barrier or insulation between longitudinally extending roof joists or wall studs secured to an exterior building surface, comprising in the following order:

positioning flexible and resilient strips in a desired longitudinal spacing in an inwardly bowed condition between adjacent roof joists or wall studs to provide air space between the strips and the exterior building surface, the strips being located within interior surfaces of the roof joists or wall studs;

thereafter positioning a radiant barrier or insulation that is separate from the bowed strips between the adjacent roof joists or wall studs in a bowed condition in engagement with the bowed strips, the radiant barrier or insulation being located within the interior surfaces of the roof joists or wall studs; and thereafter positioning flexible and resilient rods that are separate from the radiant barrier or insulation in an exposed bowed condition in engagement with the radiant barrier or insulation and over the bowed strips to secure the radiant barrier or insulation in a bowed condition to the underlying bowed strips and the adjacent roof joists or wall studs, the exposed bowed rods being located within the interior surfaces of the roof joists or wall studs;

wherein ends of the bowed strips are in engagement with the interior surfaces of the adjacent roof joists or wall studs near the exterior building surface.

2. The method of claim 1 wherein the bowed strips have flat end surfaces in engagement with the adjacent roof joists or wall studs.

3. The method of claim 1 wherein the bowed rods have pointed ends.

4. The method of claim 1 wherein the bowed strips and bowed rods are formed of metal or plastic.

5. The method of claim 1 wherein the installed strips, radiant barrier or insulation and rods are positioned at a distance within the interior surfaces of the roof joists or wall studs to allow for the installation of supplemental insulation over the installed strips, radiant barrier or insulation and rods so that the supplemental insulation is positioned within the interior surfaces of the roof joists or wall studs.

* * * * *